US006024586A

United States Patent [19]

Kumagai

[11] Patent Number: 6,024,586

[45] Date of Patent: Feb. 15, 2000

[54] GROUND TERMINAL

[75] Inventor: Yoshimitsu Kumagai, Kawagoe, Japan

[73] Assignee: Kyoshin Kogyo Co., Ltd., Tokyo, Japan

[21] Appl. No.: 08/299,101

[22] Filed: Sep. 2, 1994

[30] Foreign Application Priority Data

Nov. 25, 1993 [JP] Japan ..... 5-063282 U
Nov. 25, 1993 [JP] Japan ..... 5-063283 U
Nov. 25, 1993 [JP] Japan ..... 5-063284 U

[51] Int. Cl.[7] ..... H01R 13/648

[52] U.S. Cl. ..... 439/95; 439/83; 411/163; 411/164

[58] Field of Search ..... 439/95, 97, 83; 411/163, 164

[56] References Cited

U.S. PATENT DOCUMENTS 2,179,575 11/1939 Hosking ..... 411/163
2,778,399 1/1957 Mroz ..... 411/164
3,560,630 2/1971 Heather ..... 439/95
4,470,649 9/1984 Spencer et al. ..... 439/82

*Primary Examiner*—Gary F. Paumen

[57] ABSTRACT

A ground terminal, which is mounted to a printed board, includes a terminal body formed with a screw insertion hole, and a plurality of leads formed integrally with a lower end of the terminal body, these leads being connected to a printed board ground. The ground terminal is fastened at its terminal body, which is bent along the printed board, to a chassis ground of an electronic device by means of a screw which extends through the screw insertion hole. Thus, the printed board is electrically connected to the chassis through the ground terminal, and is hence grounded. The ground terminal is formed with a plurality of projections around the screw insertion hole. These projections are brought in urged contact with the chassis ground, to thereby prevent the ground terminal from being deformed while the ground terminal is fastened to the chassis. The terminal body has lead-side ends each of which obliquely extends to form an obtuse angle between itself and a corresponding one of the leads, to thereby prevent the ground terminal from injuring the printed board during the fastening.

7 Claims, 8 Drawing Sheets

GROUND TERMINAL

BACKGROUND OF THE INVENTION

1. Field of the Invention

The present invention relates to a ground terminal, and more particularly, to a ground terminal mounted on a printed board for establishing an electrical connection between a printed board ground and a chassis ground of an electronic device.

2. Description of the Prior Art

In the case of mounting a printed board to an electronic device, the printed board is generally to be grounded. To this end, conventionally, a printed board ground is electrically connected with a chassis ground of the electronic device with use of a ground wire, for instance. In this case, after the printed board is installed on the chassis, opposite ends of the ground wire must be soldered to the printed board ground and the chassis ground, or one end of the ground wire whose other end is soldered beforehand to the printed board ground must be soldered to the chassis ground. However, the soldering work requires much labor.

To obviate this, it has been known to mount, on a printed board, a ground terminal for establishing electrical connection between a printed board ground and a chassis ground, to thereby eliminate the need for soldering work.

As shown in FIG. 1, a conventional ground terminal 2 typically includes a terminal body 2*a*, and leads 2*b*, 2*c* and 2*d* which are integrally formed with the terminal body 2*a*. When the ground terminal 2 is installed on a printed board 1, the leads 2*b*, 2*c* and 2*d* are inserted into holes 1*a* formed in the printed board 1, and are soldered to a grounding land (not shown) formed in the rear surface of the printed board 1. Next, the ground terminal 2 is bent at nearly right angles at a boundary between the terminal body 2*a* and the leads 2*b* to 2*d*, so that the ground terminal 2 extends along the printed board 1, as shown in FIG. 2. As a result, most parts of the terminal body 2*a* are disposed at a location outside the printed board 1. When the printed board 1 is built in the electronic device, the printed board 1 is disposed at a location adjacent to a chassis ground 3, so that a screw insertion hole 2*e* formed in the outer end portion of the ground terminal 2 located outside the printed board 1 is in alignment with a screw hole 3*a* formed in the chassis ground 3. Then, a screw, loosely received in the screw insertion hole 2*e* of the ground terminal 2, is threadably engaged with the screw hole 3*a* of the chassis ground 3, and is then fastened. Whereby the ground terminal body 2*a* is fixed to the chassis ground 3, so that the printed board 1 is electrically and mechanically connected to the chassis ground through the ground terminal 2.

In another example of installation shown in FIG. 4, the leads (one of which is shown by reference numeral 2*c*) of the ground terminal 2 are received in the printed board 1 and are soldered to the grounding land 1*b* of the printed board, as in the case of FIG. 2. As distinct from the installation example shown in FIG. 2, however, the entirety of the ground terminal 2 is disposed on the upper surface 1*c* of the printed board 1. In this respect, the printed board 1 is formed with a hole 1*d* which extends through the printed board 1 and which receives the screw 4. Further, the chassis ground 3 is disposed below the printed board 1. With regard to other respects, the installation example of FIG. 4 is the same as that shown in FIG. 2, so that the printed board 1 is grounded to the chassis through the ground terminal 2 by fastening the ground terminal 2, mounted to the printed board 1, to the chassis by means of the screw 4.

The soldering work conventionally required upon installation of the printed board 1 onto the electronic equipment or the like can be eliminated by disposing the ground terminal 2 shown in FIG. 1 between the printed board and the chassis, as shown in FIG. 2 or FIG. 4. This makes it possible to improve installation efficiency.

However, since the ground terminal 2 is comprised of a thin plate and is fixed to the printed board 1 through the fine leads 2*b* to 2*d*, the ground terminal 2 can be deformed when it receives a fastening force when the ground terminal 2 is fastened to the chassis with use of the screw 4. Namely, the ground terminal body 2*a* can be bent, or the leads 2*b* to 2*d* can be twisted.

Further, if dust, oil film or the like is adhered to opposite surfaces of the ground terminal body 2*a* and the chassis ground 3, these elements 2*a* and 3 which are subsequently caused to be in contact with each other are electrically insulated by the dust or the like, so that a defective electrical connection can be established between the terminal body 2*a* and the chassis ground 3.

Moreover, as shown in FIGS. 1 and 3, the conventional ground terminal 2 is cut at right angles at its corners 2*f* of those portions at which the terminal body 2*a* is combined with the opposite leads 2*b* and 2*d*. Thus, the corners 2*f* of the ground terminal 2 can be brought in contact with the upper surface of the printed board 1 when the ground terminal 2 is bent along the upper surface of the printed board 1 as mentioned above, so that the surface of the printed board 1 is injured. In this case, the appearance of the printed board 1 is deteriorated. Further, in the case of a double-sided printed board, a land (conductor pattern) formed in the upper surface of the board can be injured or cut off.

SUMMARY OF THE INVENTION

An object of the present invention is to provide a ground terminal which is difficult to be deformed even if a fastening force is applied when the ground terminal installed on a printed board is fastened, by means of a screw, to a chassis of an electronic device to which the printed board is mounted.

Another object of the present invention is to provide a ground terminal which is capable of establishing ensured electrical connection between a printed board and a chassis of an electronic device.

A further object of the present invention is to provide a ground terminal which prevents a printed board from being injured when the ground terminal installed on the printed board is bent along the printed board.

According to one aspect of the present invention, a ground terminal has a terminal body which is formed with a screw insertion hole, and a plurality of leads which are formed integrally with the terminal body. The ground terminal is adapted to be bent at a boundary portion between the terminal body and the plurality of leads, with the leads mounted to a printed board. Further, the ground terminal is adapted to be fastened to a chassis of an electronic device by means of a screw which is received in the screw insertion hole. The ground terminal includes a plurality of projections which are formed in the terminal body around the screw insertion hole.

The ground terminal according to the one aspect of the invention is advantageous in that the ground terminal is in point-contact with the chassis at the plurality of projections when the ground terminal installed on the printed board is fastened to the chassis, so as to prevent a rotary motion of the ground terminal attributable to a fastening force applied to the ground terminal, whereby the ground terminal is prevented from being deformed. Further, since the ground terminal is in point-contact with the chassis at the projections, electrical connection between the ground terminal and the chassis can be ensured.

Preferably, each of the plurality of projections has a tip end which is formed into a point-shape.

This preferred embodiment is advantageous in that the point-shaped tip end of each projection of the ground terminal cuts into the chassis, while destroying dust, oil film or the like which is adhered to opposite surfaces of the ground terminal and the chassis, when the ground terminal is fastened to the chassis with use of a screw. This prevents electrical insulation between the ground terminal and the chassis attributable to dust or the like interposed therebetween, so that electrical connection between the ground terminal and the chassis can be ensured. Further, when the ground terminal is fastened to the chassis, a rotary motion of the ground terminal is prevented, to thereby prevent deformation of the ground terminal.

According to another aspect of the present invention, the terminal body of the ground terminal has opposite edges each having a lead-side end which obliquely extends in a direction away from a corresponding one of the plurality of leads to form an obtuse angle between itself and the corresponding one lead.

The ground terminal according to this aspect of the invention is advantageous in that the ends of the opposite edges of the ground terminal body are out of contact with the printed board when the ground terminal is bent at the boundary portion between the terminal body and the leads. This prevents the ground terminal from injuring a surface of the printed board and a conductor pattern formed in the printed board. Thus, the appearance and operational reliability of the printed board are ensured.

These and other objects and advantages will become more readily apparent from an understanding of the preferred embodiments described below with reference to the following drawing figures.

BRIEF DESCRIPTION OF THE DRAWINGS

The invention will become more fully understood from the detailed description hereinbelow with reference to the accompanying figures, given by way of illustration only and not intended to limit the present invent in which.

DETAILED DESCRIPTION

With reference to FIGS. 5 to 7 and 16, a ground terminal according to a first embodiment of the present invention will be explained.

Figure 16:
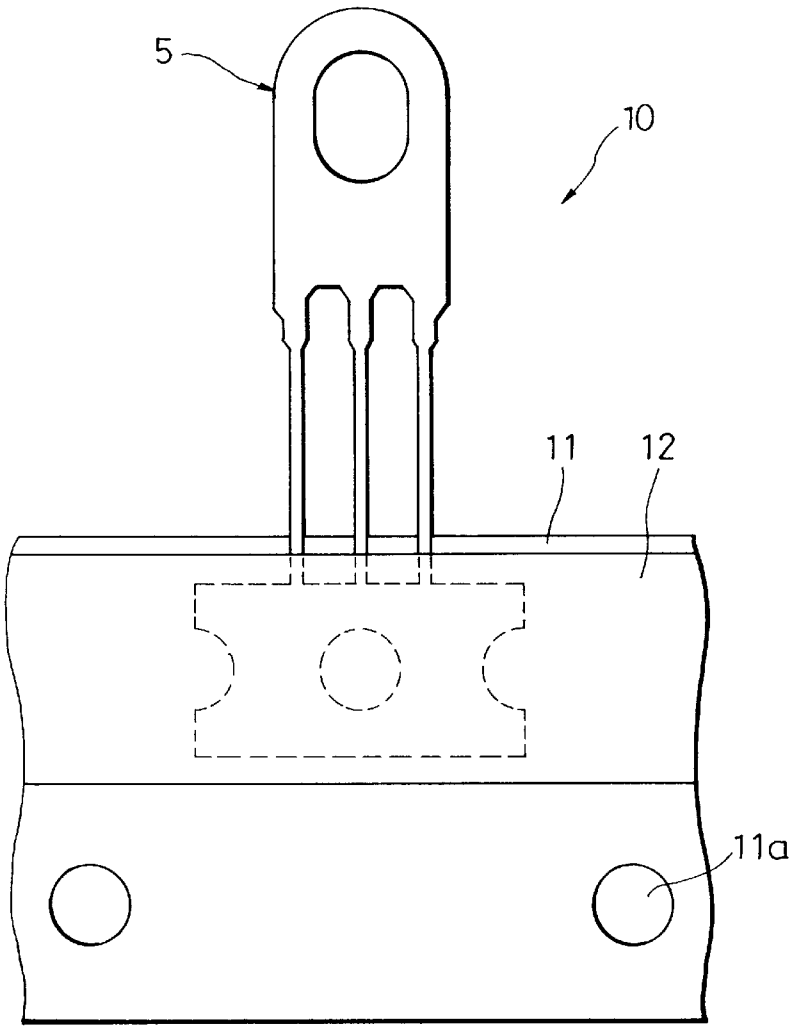
FIG. 16 is a front view showing a ground terminal assembly which includes ground terminals one of which is shown in FIG. 5.

The ground terminal of the present embodiment is adapted to be installed on a printed board with use of an electronic component automatic loader (not shown). To this end, the ground terminal is mounted to the automatic loader, in the form of a ground terminal assembly 10 which is shown in FIG. 16 and which is comprised of a plurality of ground terminals (one of which is shown by reference numeral 5) affixed to a lead frame 11 by means of an adhesive tape 12. Each of the ground terminals 5 is adapted to be sequentially cut off from the ground terminal assembly 10 for installation onto the printed board.

Figure 1:
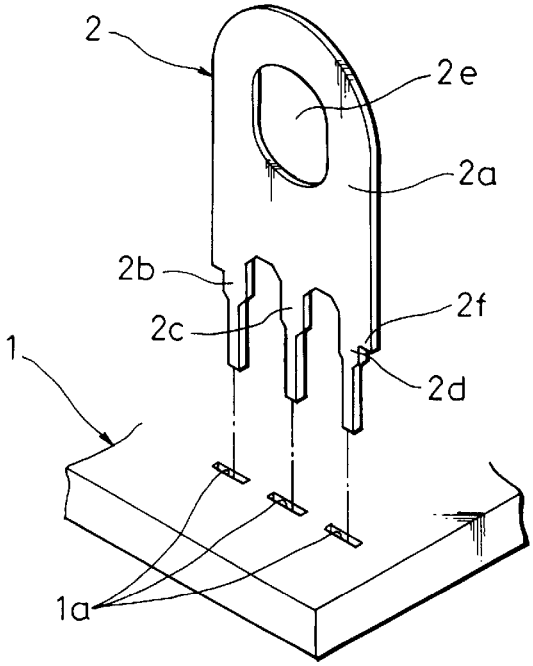
FIG. 1 (CONVENTIONAL ART)
FIG. 1 is a perspective view showing a conventional ground terminal together with a printed board.
Figure 2:
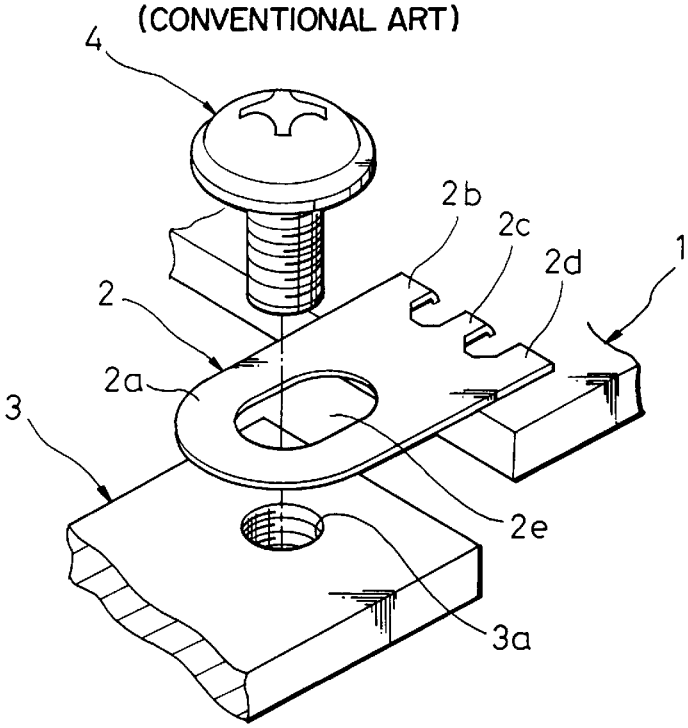
FIG. 2 (CONVENTIONAL ART)
FIG. 2 is a perspective view showing an example of installation of the ground terminal, shown in FIG. 1 and installed on the printed board, to a chassis of an electronic device.
Figure 3:
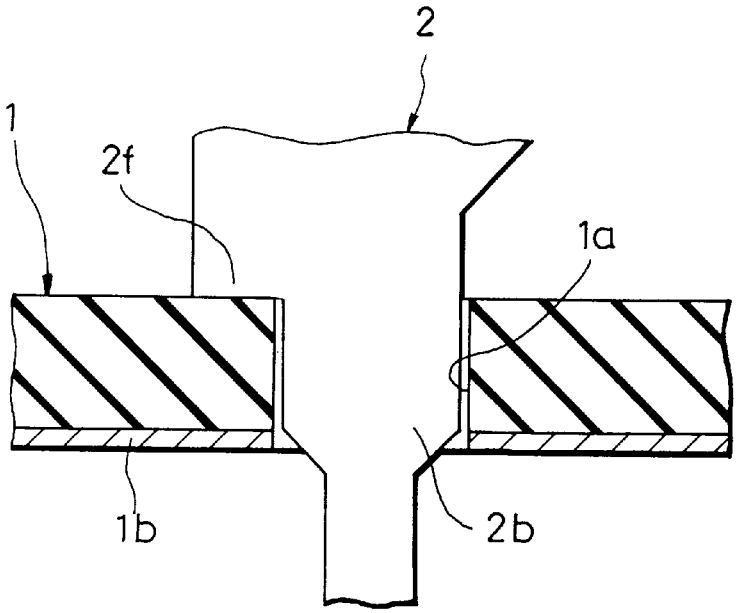
FIG. 3 (CONVENTIONAL ART)
FIG. 3 is an enlarged sectional view showing a combined portion of a terminal body and one of the leads of the ground terminal shown in FIG. 1, with the lead received in a hole of the printed board.
Figure 4:
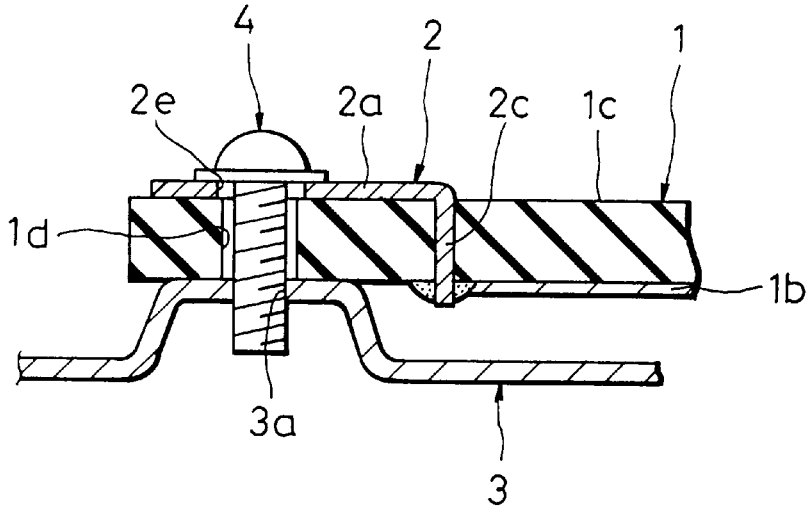
FIG. 4 (CONVENTIONAL ART)
FIG. 4 is a sectional view showing another example of installation of the ground terminal shown in FIG. 1 to a chassis of an electronic device.
Figure 5:
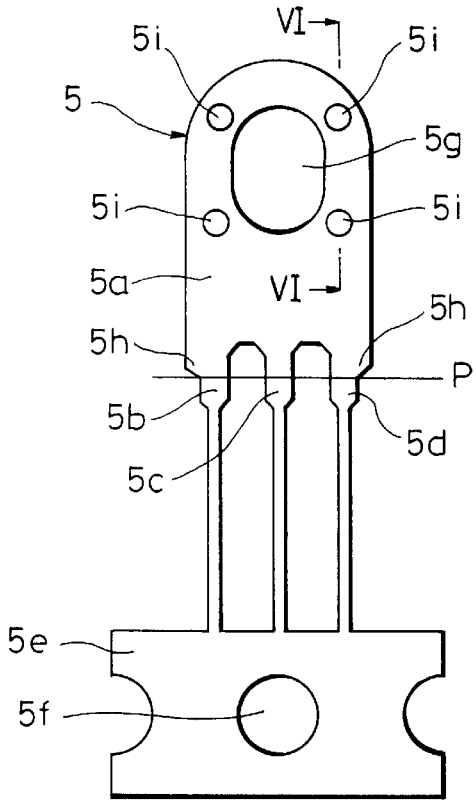
FIG. 5 is a front view showing a ground terminal according to a first embodiment of the present invention.
Figure 6:
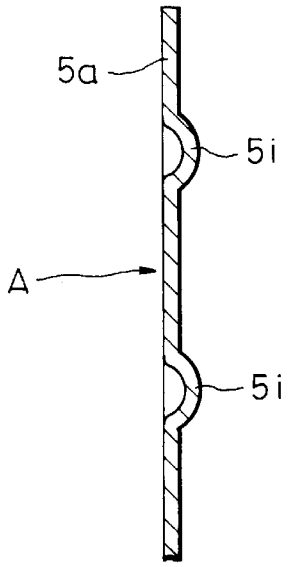
FIG. 6 is a fragmentary enlarged sectional view of the ground terminal taken along line VI—VI shown in FIG. 5.

Referring to FIG. 5, the ground terminal 5 includes a terminal body 5*a* for establishing electrical connection between itself and a chassis 3 (FIG. 8 or 9) of an electronic device (not shown), a plurality of, e.g., three leads 5*b* to 5*d* integrally formed with the terminal body 5*a* for establishing electrical connection between themselves and a printed board 1 (FIG. 8 or 9), and a proximal section 5*e* formed integrally with the leads 5*b* to 5*d*. The ground terminal 5 is adapted to be affixed at its proximal section 5*e* to the lead frame 11.

The terminal body 5*a* of the ground terminal 5 is formed into a rectangular shape whose vertical length is slightly longer than the width of the ground terminal 5, and has its upper portion formed into a semi-circle, as viewed from the front of the ground terminal. The terminal body 5*a* is formed with an elongated hole 5*g* along the longitudinal axis of the terminal body. The elongated hole 5*g*, serving as a screw insertion hole, extends from the upper end portion of the terminal body 5*a* to a central part thereof. As shown by way of example in FIGS. 8 and 9, the ground terminal 5 is adapted to be fastened to the chassis 3 with use of a screw 4 which extends through the screw insertion hole 5*g*.

The terminal body 5*a* is formed with a plurality of, e.g., four projections 5*i* which are located around the elongated hole 5*g*. Each projection 5*i*, which is formed into a semisphere, projects in a screw fastening direction shown by the arrow A in FIG. 6. Preferably, these projections 5*i* are formed in such a manner that the distance between a pair of adjacent projections is the same as that between another projection pair.

Figure 7:
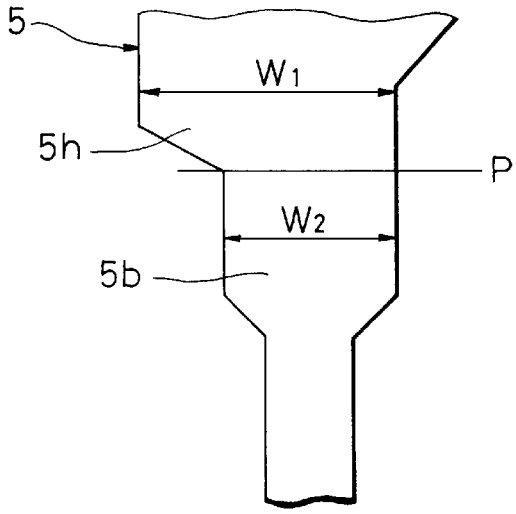
FIG. 7 is a fragmentary enlarged view showing a combined portion between the terminal body and one of the leads of the ground terminal shown in FIG. 5.

As shown in FIGS. 5 and 7, the terminal body 5*a* has opposite side edges each having a corner 5*h* at its lower end, the corner 5*h* extending obliquely upwardly to form an obtuse angle between itself and a corresponding one of the leads 5*b* and 5*d*. At a location shown by the line P in FIGS. 5 and 7, the terminal body 5*a* is combined with the leads 5*b* and 5*d*. As shown in FIG. 7, the lead 5*b* has its width W2 (more generally, cross sectional area) which is smaller than the width W1 of the lead-side end of the terminal body 5*a*. Likewise, the lead 5*d* has its width smaller than that of the lead-side end of the terminal body 5*a*. Further, the terminal body 5*a* is formed with notches at locations between the leads 5*b* and 5*c* and between the leads 5*c* and 5*d*. In other words, the lead 5*c*, which is centrally disposed in the width direction of the ground terminal 5, is combined with the terminal body 5*a* on the side close to the elongated hole 5*g* with respect to the combined portions between the opposite leads 5*b*, 5*d* and the terminal body 5*a*.

The above-mentioned arrangement in respect of the combined portions between the terminal body 5*a* and the leads 5*b* to 5*d* makes it possible for the ground terminal 5 to be easily bent at a bendable position shown by the line P when the ground terminal 5 is bent, with the leads 5*b* to 5*d* embedded in the printed board 1.

In the above, the leads 5*b* and 5*d* have been explained as indicating those portions which extend from the upper end of the proximal section 5*e* to the bendable position P. Alternatively, those portions which extend up to locations located slightly closer to the elongated hole 5*g* than the bendable position P can be called leads 5*b*, 5*d*. In this case, the bendable position P is included in the leads 5*b* to 5*d*.

In manufacturing a ground terminal assembly 10 (FIG. 16) including the ground terminal 5 having the aforementioned construction, a ground terminal strip (not shown) is stamped out from a metal strip (not shown), and the projections 5*i* are formed in each ground terminal 5 by stamping. Then, the proximal section 5*e* of the ground terminal strip is cut at locations between adjacent ground terminals, to thereby obtain the independent ground terminals 5. The thus obtained independent ground terminals 5 are arranged on the lead frame 11 at intervals equal to perforation intervals such that each ground terminal 5 is situated halfway between each two adjacent perforations 11*a* in the lead frame 11. Then, the respective proximal sections 5*e* of the ground terminals 5 are affixed on the lead frame 11 by means of the adhesive tape 12, to thereby obtain the ground terminal assembly 10 which is comprised of the ground terminals 5 and the lead frame 11. In FIG. 5, reference numeral 5*f* denotes a positioning hole used when the ground terminals 5 are disposed on the lead frame 11.

In mounting the ground terminals 5 on the printed board 1, the perforations 11*a* of the lead frame 11 of the ground terminal assembly 10 are caused to engage the sprocket of the automatic loader (not shown), and the loader is then actuated to rotate the sprocket. By doing this, the ground terminal assembly 10 is transported to the position where its leading ground terminal 5 faces a chuck (not shown) of the loader. After the leading terminal is held by the chuck, the chuck is moved so that the ground terminal assembly 10 is delivered to the position where it faces a cutter (not shown) of the loader. Then, the ground terminal assembly 10 is cut along the boundary between the leading ground terminal 5 and its subsequent one by the cutter, whereby a combination of the leading ground terminal 5 and the lead frame 11 associated therewith is separated from the ground terminal assembly 10. Further, after the chuck is horizontally turned to rotate the combination of the leading ground terminal 5 and the lead frame 11 through 90 degrees around the cutter, the lead frame 11 is cut off from the ground terminal 5 by the cutter.

Subsequently, the chuck is moved to locate the ground terminal 5 in a position such that the leads 5*b* to 5*d* of the ground terminal 5 face the three through holes (corresponding to holes 1*a*) of the printed board 1, respectively. Thereafter, the chuck is moved so that the leads 5*b* to 5*d* are inserted individually into the through holes. After the chuck is released so that the ground terminal 5 is disengaged from the chuck, the terminal 5 is pressed by a pusher (not shown) of the automatic loader, so that the leads 5*b* to 5*d* are further pushed into their corresponding through holes up to the bendable position P. Then, extra portions of the leads 5*b* to 5*d* are cut off, whereupon automatically loading the printed board 1 with the leading ground terminal 5 is finished.

Next, by soldering, the leads 5*b* to 5*d* of the ground terminal 5 are electrically connected to and mechanically combined with a grounding land formed in the rear surface of the printed board 1, to thereby finish mounting the ground terminal 5 to the printed board 1. Meanwhile, the printed board 1 is loaded with various electronic components (not shown).

Figure 8:
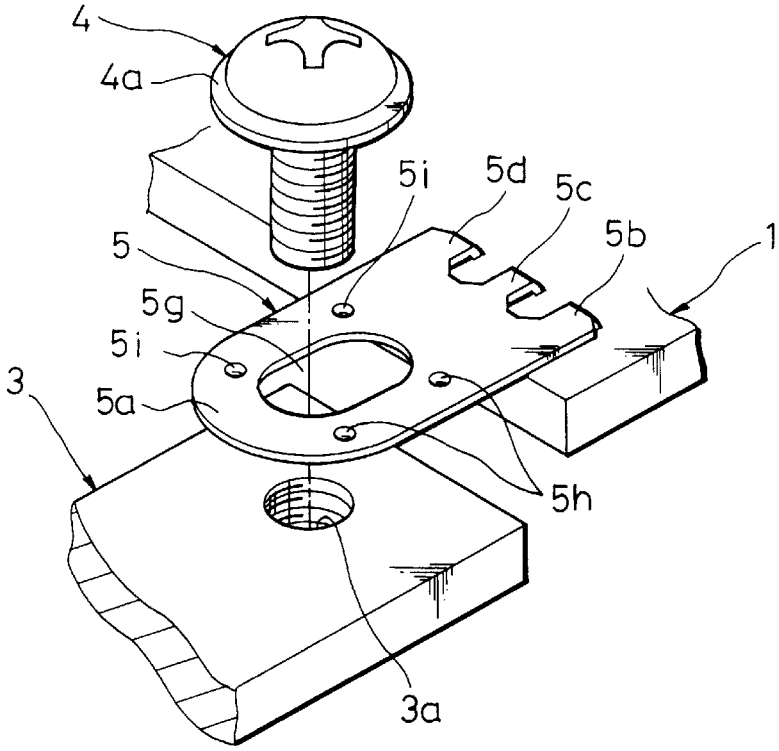
FIG. 8 is a perspective view showing an example of installation of the ground terminal, shown in FIG. 5 and installed on a printed board, to a chassis of an electronic device.

After the ground terminal 5 is mounted to the printed board 1, the terminal body 5*a* is bent at nearly right angles along the upper surface of the printed board 1, as shown in FIG. 8. Since the width W2 (FIG. 7) of the ground terminal 5 at the boundary (bendable portion P) between the terminal body 5*a* and the leads 5*b*, 5*d* is smaller than the width W1 of the ground terminal 5 at the lower end portion of the terminal body 5*a*, the ground terminal 5 is easily bent at the bendable position P. More generally, the ground terminal 5 is bent at a boundary portion (at or in the vicinity of the bendable position P or at end portions of the leads 5*b* to 5*d* on the side close to the ground terminal body 5*a*).

Further, since the corners 5*h* at the lower ends of the opposite side edges of the terminal body 5*a* are cut out obliquely and upwardly, and are hence separated from the upper surface of the printed board 1, the upper surface of the printed board 1 is not injured by the corners 5*h* of the ground terminal 5 when the terminal 5 is bent. Moreover, in the case of a double-sided printed board, a land (conductor pattern) formed on the upper surface of the printed board is not injured. After the ground terminal 5 is bent, the projections 5*i* of the terminal body 5*a* are disposed so that tip ends of these projections 5*i* face a chassis ground 3.

When the printed board 1 is mounted to an electronic device (not shown), the ground terminal body 5*a* is disposed in alignment with the chassis ground 3, and is then fastened to the chassis ground 3 by means of a screw 4 which is received in the elongated hole 5*g* of the ground terminal 5. Upon the ground terminal 5 being fastened, the tip ends of the projections 5*i* of the terminal body 5*a* are brought in urged contact with the upper surface of the chassis ground 3, so that the ground terminal 5 is caused at its projections 5*i* to be in point-contact with the chassis. As a result, the printed board 1 is electrically connected to the chassis ground 3 through the ground terminal 5, so that the printed board 1 is grounded. Further, since the ground terminal 5 is in point-contact with the chassis, and hence the projections 5*i* cut into the chassis. Thus, the terminal body 5*a*, which would be otherwise rotated when it receives a fastening force from the screw 4, is prevented from rotating, to thereby prevent a bending deformation of the terminal body 5*a* and a twisting deformation of the leads 5*b* to 5*d*. With the arrangement in which the projections 5*i* are disposed at equal interval, prevention of deformation of the ground terminal 5 can be ensured.

The elongated hole 5*g* permits slight deviations between mounting positions of the printed board 1 and the chassis and between mounting positions of the ground terminal 5 and the printed board 1, whereby the ground terminal 5 can be mounted to the chassis even if such a slight deviation is present.

Figure 9:
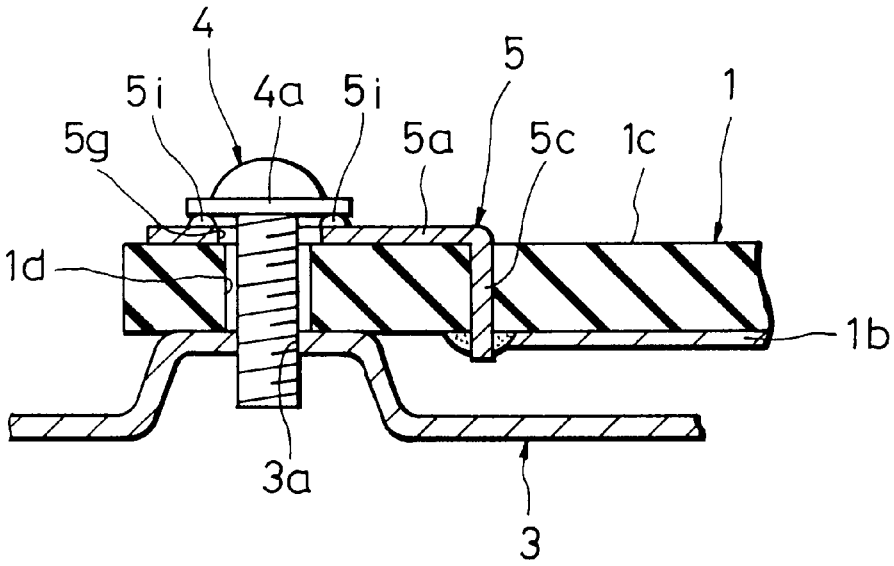
FIG. 9 is a sectional view showing another example of installation of the ground terminal shown in FIG. 5 to a chassis of an electronic device.
Figure 10:
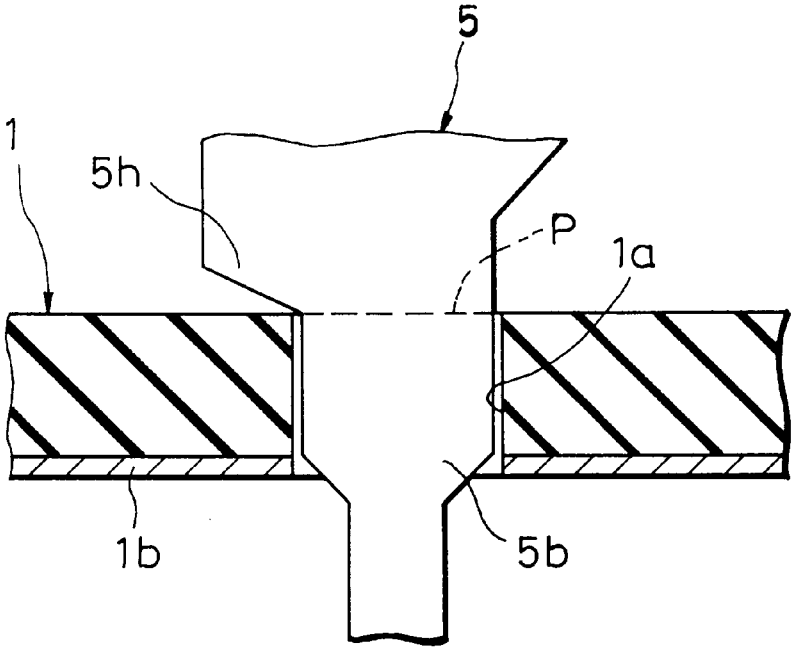
FIG. 10 is an enlarged sectional view showing a combined portion of a terminal body and one of leads of the ground terminal shown in FIG. 5, with the lead received in a hole of the printed board.

FIG. 9 shows another manner of mounting a ground terminal 5, which is different from that shown in FIG. 8. Referring to FIG. 9, the entirely of a terminal body 5*a* of the ground terminal 5 is abutted against the upper surface 1*c* of a printed board 1. A screw 4 is inserted through a hole 5*g* of the ground terminal 5 and a hole 1*d* of the printed board 1, and is threadably engaged with a screw hole 3*a* which is formed in a chassis ground 3 of an electronic device. By fastening the screw 4, the ground terminal 5 is fixed to the printed board 1, and projections 5*i* are brought into urged contact with a washer 4*a* for the screw 4, to thereby establish electrical connection between themselves and the chassis ground 3.

In the following, a ground terminal according to a second embodiment of the present invention will be explained with reference to FIGS. 11 through 14.

The basic construction of the ground terminal 5 of the present embodiment is the same as that of the aforementioned first embodiment, so that explanations as the construction and function of those elements which are common to both the embodiments will be omitted hereinbelow. The ground terminal 5 is featured in that projections 5*j* whose tip ends are formed into a point-shape are provided in a terminal body 5*a* of the ground terminal 5, instead of the projections 5*i* of the first embodiment.

Figure 11:
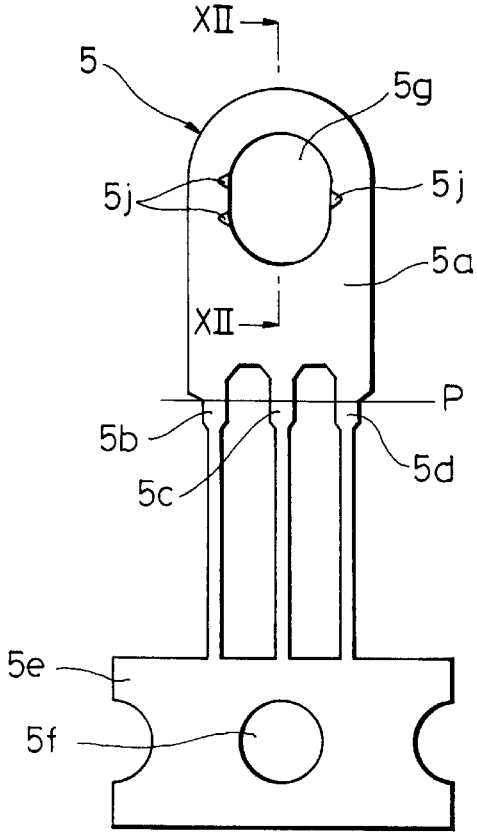
FIG. 11 is a front view showing a ground terminal according to a second embodiment of the present invention.
Figure 12:
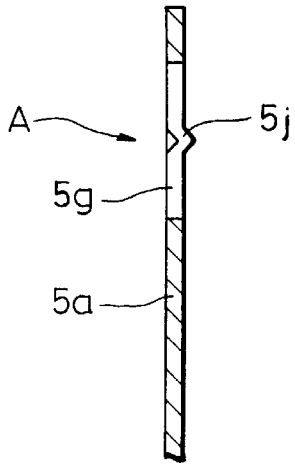
FIG. 12 is a fragmentary enlarged sectional view of the ground terminal taken along line XII—XII line shown in FIG. 11.

Referring to FIGS. 11 and 12, a plurality of, e.g., three projections 5*j*, each having a tip end which is formed into a point-shape, are provided on the peripheral edge of an elongated hole 5*g* formed in the ground terminal body 5*a*. Each projection 5*j* has one side thereof which is open to a wall surface which defines the elongated hole 5*g*, and projects in a screw fastening direction shown by the arrow A in FIG. 12, so that the point-shaped tip end of the projection 5*j* is adapted to abut against a chassis ground 3.

Figure 13:
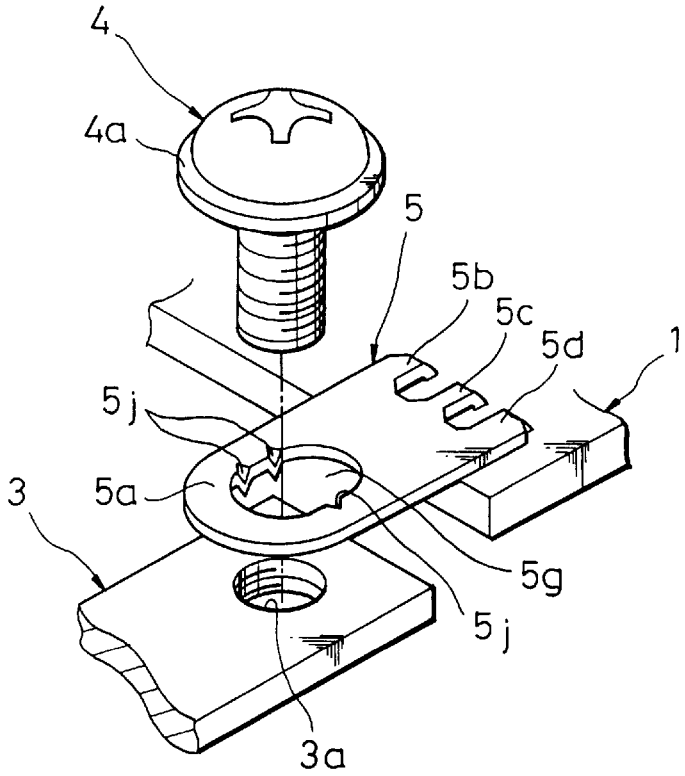
FIG. 13 is a perspective view showing an example of installation of the ground terminal, shown in FIG. 11 and installed on a printed board, to a chassis of an electronic device.

As shown in FIG. 13 which corresponds to FIG. 8, the ground terminal 5 having the aforementioned construction is mounted to the printed board 1 as in the case of the foregoing first embodiment, and is then bent along the upper surface of the printed board 1 at nearly right angles. When the printed board 1 is installed in an electronic device (not shown), each of the projections 5*j* of the ground terminal body 5*a* is disposed such that the tip end thereof faces the chassis ground 3. Thus, the ground terminal 5 is fixed to the chassis ground 3 by means of a screw 4 which extends through the elongated hole 5*g*.

When the ground terminal 5 is fastened to the chassis, the tip ends of the projections 5*j* of the ground terminal 5 are brought in contact with the upper surface of the chassis ground 3. As the ground terminal 5 is fastened by the screw 4, the point-shaped tip ends of the projections 5*j* cut into the surface of the chassis ground 3. At this time, an electrical insulation layer formed by dust, oil film or the like which is adhered to the surface of the chassis ground 3 is destroyed by the point-shaped tip ends of the projections 5*j* which are then in contact with the chassis ground 3. This establishes appropriate electrical connection between the ground terminal body 5*a* and the chassis ground 3. Since the point-shaped tip ends of the projections 5*j* cut into the chassis, a rotary motion as well as deformation of the ground terminal 5 are prevented as the ground terminal 5 is fastened to the chassis.

Figure 14:
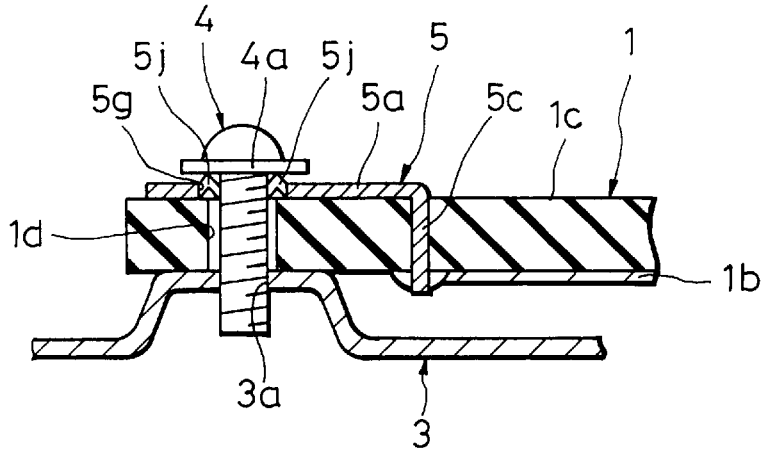
FIG. 14 is a sectional view showing another example of installation of the ground terminal shown in FIG. 11 to a chassis of an electronic device.

FIG. 14 shows an example, corresponding to FIG. 9, of ground terminal installation. The aforementioned explanation regarding FIG. 9 is incorporated herein, and a repeated explanation for FIG. 14 will be omitted.

The present invention is not limited to the foregoing first and second embodiments, and may be modified in various manners.

Although the ground terminal 5 of the first embodiment is provided with four projections 5*i*, and the ground terminal 5 of the second embodiment is provided with three projections 5*j*, the number of projections is not limited thereto. For instance, three or five projections may be provided in the first embodiment, and four or five projections may be provided in the second embodiment.

Further, in the first embodiment, each of the projections 5*i* provided at locations around the elongated hole 5*g* of the terminal body 5*a* is formed into a semi-spherical shape. Alternatively, each projection 5*i* may have a tip end formed into a point-shape.

Figure 15:
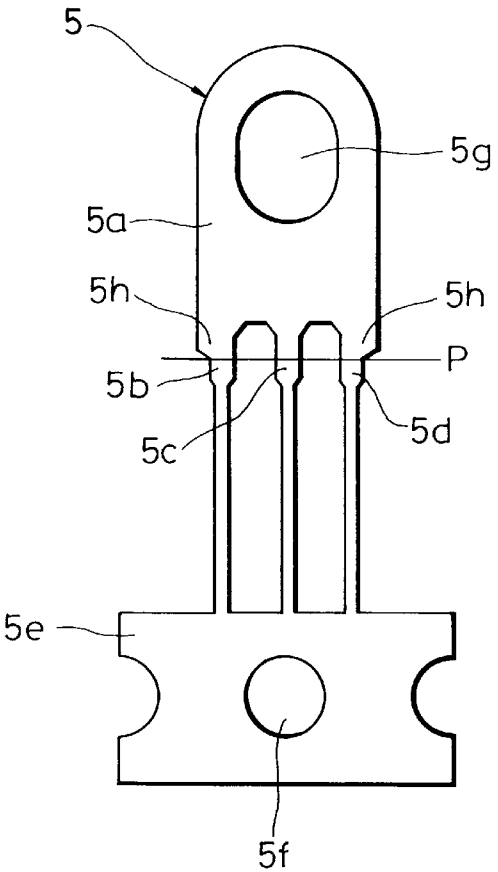
FIG. 15 is a front view showing a modification of the ground terminal according to the first or second embodiment of the present invention.

Although the projections 5*i* or 5*j* are provided in the ground terminal body 5*a* in the first or second embodiment, it is not inevitably necessary to provide the ground terminal 5 with projections. FIG. 15 shows a modification in which the projections 5*i* or 5*j* provided in the first or second embodiment are removed. In this modification, corners 5*h* of lead-side ends of a ground terminal 5 are cut obliquely and upwardly, to thereby prevent the corners 5*h* of the ground terminal 5 from injuring a printed board 1 when the ground terminal 5 is bent toward the printed board 1, as in the first and second embodiments.

Moreover, in the foregoing embodiments, a ground terminal assembly is obtained by sticking a plurality of ground terminals 5 to a lead frame by a tape, the terminals 5 being obtained by cutting a ground terminal strip with the ground terminals 5 arranged thereon at intervals shorter than the intervals between the sprocket teeth of an automatic loader, in order to improve the efficiency of utilization of a ground terminal strip as a material. Alternatively, however, a ground terminal strip having ground terminals arranged at intervals equal to the sprocket tooth intervals may be used as the ground terminal assembly. In this case, perforations are formed in the strip at intervals equal to the sprocket tooth intervals.

From the above-described embodiments of the present invention, it is apparent that the present invention may be modified as would occur to one of ordinary skill in the art without departing from the spirit and scope of the present invention which should be defined solely by the appended claims. All such modifications as would be obvious to one of ordinary skill in the art should not be regarded as a departure from the spirit and scope of the invention, and should be included within the scope of the invention as defined solely by the appended claims.

What is claimed is:

1. A ground terminal having a terminal body which is formed with a screw insertion hole, and a plurality of leads which are formed integrally with the terminal body, the ground terminal being adapted to be bent at a boundary portion thereof between the terminal body and the plurality of leads, with the plurality of leads mounted to a printed board having a corresponding plurality of lead receiving holes, and being adapted to be fastened to a chassis of an electronic device by means of a screw which is received in the screw insertion hole, the improvement comprising:

a plurality of projections formed in the terminal body around the screw insertion hole for preventing deformation of said ground terminal during screw fastening of said terminal to said chassis; and means for spacing lower ends of opposite side edges of the terminal body from an upper planar surface of the printed board upon complete insertion of said plurality of leads into respective ones of said plurality of lead receiving holes, thereby preventing damage to the upper planar surface of the printed board, wherein the terminal body of the ground terminal has opposite edges each having a lead-side end which obliquely extends in a direction away from a corresponding one of said plurality of leads at said boundary portion to form an obtuse angle between said lead-side end of said terminal body and said corresponding one lead, wherein an entirety of the obliquely extended opposite edges are positioned above the planar surface of the printed board.

2. The ground terminal according to claim 1, wherein said plurality of projections are formed on a peripheral edge of the screw insertion hole.

3. The ground terminal according to claim 1, wherein each of said plurality of projections has a tip end which is formed into a point-shape.

4. The ground terminal according to claim 2, wherein each of said plurality of projections has a tip end which is formed into a point-shape.

5. A ground terminal having a terminal body which is formed with a screw insertion hole, and a plurality of leads which are formed integrally with the terminal body, the ground terminal being adapted to be bent at a boundary portion thereof between the terminal body and the plurality of leads, with the leads mounted by insertion into a printed board, and being adapted to be fastened to a chassis of an electronic device by means of a screw which is received in the screw insertion hole, the improvement comprising:

the terminal body of the ground terminal having opposite edges each having a lead-side end which obliquely extends in a direction away from a corresponding one of said plurality of leads at said boundary portion to form an obtuse angle between said lead-side end of the terminal body and said corresponding one lead, thereby spacing the lower ends of the opposite side edges of the terminal body from the upper planar surface of the printed board such that an entirety of the edges are positioned above the planar surface of the printed board.

6. The ground terminal according to claim 5, further comprising a plurality of projections formed on a peripheral edge of the screw insertion hole.

7. The ground terminal according to claim 6, wherein each of said plurality of projections has a tip-end which is formed into a point-shape.

* * * * *